US009446612B1

(12) United States Patent
Butterfield

(10) Patent No.: US 9,446,612 B1
(45) Date of Patent: Sep. 20, 2016

(54) MULTIPLE-GRIPPER ARCHITECTURE FOR MULTI-SHEET-LENGTH DIGITAL PRINTING

(71) Applicant: Xerox Corporation, Norwalk, CT (US)

(72) Inventor: Paul M. Butterfield, Ontario, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/966,042

(22) Filed: Dec. 11, 2015

(51) Int. Cl.

| | |
|---|---|
| ***B41J 13/22*** | (2006.01) |
| ***B41J 11/04*** | (2006.01) |
| ***B65H 5/12*** | (2006.01) |
| ***B65H 5/14*** | (2006.01) |
| ***B41J 13/00*** | (2006.01) |

(52) U.S. Cl.
CPC ..... *B41J 13/223* (2013.01); *B41J 11/04* (2013.01); *B41J 13/0054* (2013.01); *B65H 5/12* (2013.01); *B65H 5/14* (2013.01)

(58) Field of Classification Search
CPC ..... B41F 21/04; B41F 21/10; B41F 1/30; B65H 5/14; B65H 5/12; B41J 13/223; B41J 13/22
See application file for complete search history.

(56) References Cited

U.S. PATENT DOCUMENTS

| | | | | |
|---|---|---|---|---|
| 3,148,878 | A | 9/1964 | Eichorn | |
| 4,069,728 | A | 1/1978 | McCrea | |
| 4,276,978 | A | 7/1981 | Deguchi et al. | |
| 4,807,867 | A | 2/1989 | Lippold et al. | |
| 4,875,069 | A * | 10/1989 | Takada | G03G 15/1655 101/408 |
| 4,972,234 | A | 11/1990 | Tanaka et al. | |
| 5,425,837 | A | 6/1995 | Hansch | |
| 5,671,671 | A * | 9/1997 | Wyssmann | B41F 15/0809 101/120 |
| 6,109,173 | A * | 8/2000 | Nakayama | B41L 13/06 101/118 |
| 6,293,544 | B1 | 9/2001 | Fedinatz | |
| 6,367,909 | B1 | 4/2002 | Lean | |
| 6,478,297 | B1 | 11/2002 | Messerschmid | |
| 6,637,744 | B2 | 10/2003 | Bettinelli | |
| 7,360,759 | B2 | 4/2008 | Ramseier et al. | |
| 7,792,609 | B2 | 9/2010 | Strasser et al. | |
| 7,857,305 | B2 | 12/2010 | Sokolowski | |
| 8,123,221 | B2 | 2/2012 | Blumle | |
| 8,376,348 | B2 | 2/2013 | Keller | |
| 8,976,409 | B2 | 3/2015 | Hunter | |
| 2006/0108061 | A1 | 5/2006 | Winter et al. | |
| 2012/0092431 | A1* | 4/2012 | Hara | B41J 13/223 347/104 |
| 2013/0234386 | A1 | 9/2013 | Murakami et al. | |
| 2013/0300057 | A1* | 11/2013 | Kondo | B41F 21/106 271/270 |
| 2014/0020583 | A1* | 1/2014 | Barazani | B41F 21/04 101/246 |

* cited by examiner

*Primary Examiner* — Daniel J Colilla
(74) *Attorney, Agent, or Firm* — Gibb & Riley, LLC

(57) ABSTRACT

Devices and methods to enable a sheet conveyance system within a printing device. According to an apparatus herein, a sheet supply device feeds substrates to a printing system. The apparatus includes an impression cylinder. A first gripper is positioned in a first location on a circumferential wall of the impression cylinder. A second gripper is positioned in a second location on the circumferential wall of the impression cylinder. The second location is angularly spaced apart from the first location around the circumferential wall. A cover selectively covers the second gripper. Responsive to the first gripper gripping an edge of a substrate of a first length supplied from the sheet supply device, the first length being greater than the length of the circumferential arc between the first gripper and the second gripper, the cover provides a smooth curved surface over the second gripper.

20 Claims, 4 Drawing Sheets

MULTIPLE-GRIPPER ARCHITECTURE FOR MULTI-SHEET-LENGTH DIGITAL PRINTING

BACKGROUND

Devices and methods herein generally relate to machines such as printers and/or copier devices and, more particularly, to gripper architecture for sheet conveyance.

Marking systems that transport paper or other media are well known in the art. These marking systems include electrostatic marking systems, non-electrostatic marking systems, printers, or any other marking system where paper, or other flexible media or sheets, are transported internally.

In printing systems, there exist a variety of systems and methods for handling sheets of different sizes. Some systems convey sheets via systems of belts or rollers, which provide superb flexibility for sheets of different sizes. But, in these systems, slippage between sheets and their conveyance mechanism can create mis-registration between sheets and the printed image that is applied to them.

The gripper-based architecture of traditional offset lithography provides the most robust system for sheet registration. This is because, in a gripper-based architecture, once a sheet is seized in a gripper, it remains rigidly clamped in that gripper (or is passed via a system with high mechanical tolerances to subsequent grippers) until all printing processes are completed.

However, because lithographic systems are based on a master (printing plate) of typically fixed size, lithographic gripper-system architectures are ill suited for adaptation to digital printing systems where sheet size might be variable. While one might propose creation of a system with multiple grippers positioned for multiple sheet lengths, in practice such a system would induce print quality defects for long sheets, the cause of the defects being the unsupported portion of the sheet that bridges the gap where the additional short-sheet grippers are located. Due to the unwanted gap, heretofore, a multiple-gripper-for-multiple sheet-length architecture was not practical. Hence, the cadence of gripping relative to sheet velocity is fixed at a single value.

A principle advantage of digital printing is that small sheets may be printed at a faster rate (commensurate with their length) than larger sheets. But digital architectures have heretofore been unable to enjoy the image-to-paper registration precision characteristics of a gripper system, while maintaining the advantage of efficient rates on smaller sheets. Architectures could achieve registration precision or speed efficiency across sizes, but not both.

SUMMARY

Disclosed herein is a modification of the traditional lithographic press architecture to enable multiple points for gripping a sheet. This would provide the time-proven registration advantages of gripper-based architectures, while also achieving efficient print rates for smaller sheet sizes.

According to an apparatus herein, a sheet supply device feeds substrates to a printing system. The apparatus includes an impression cylinder. A first gripper is positioned in a first location on a circumferential wall of the impression cylinder. A second gripper is positioned in a second location on the circumferential wall of the impression cylinder. The second location is angularly spaced apart from the first location around the circumferential wall. A cover selectively covers the second gripper. Responsive to the first gripper gripping an edge of a substrate of a first length supplied from the sheet supply device, the first length being greater than the length of the circumferential arc between the first gripper and the second gripper, the cover provides a smooth curved surface over the second gripper.

According to a sheet registration and conveyance system herein, the system comprises an impression cylinder. A first gripper is positioned in a first location on a circumferential wall of the impression cylinder. A second gripper is positioned in a second location on the circumferential wall of the impression cylinder. The second location is angularly spaced apart from the first location around the circumferential wall. The system includes sheet supply devices supplying first substrates having a first length and second substrates having a second length. The first length is greater than the length of the circumferential arc between the first gripper and the second gripper and the second length is less than the length of the circumferential arc between the first gripper and the second gripper. Responsive to substrates of the second length being supplied, the first gripper grips a leading edge of a first sheet from a sheet supply device and the second gripper grips a leading edge of a second sheet from the sheet supply device. Responsive to substrates of the first length being supplied, the first gripper grips a leading edge of a sheet from the sheet supply device and the cover provides a smooth curved surface over the second gripper.

A printing system herein includes a processor, a marking device operatively connected to the processor, and sheet supply devices. The sheet supply devices supply sheets of a first length and sheets of a second length to the marking device. The marking device comprises an impression cylinder. A first gripper is positioned in a first location on a circumferential wall of the impression cylinder. A second gripper is positioned in a second location on the circumferential wall of the impression cylinder. The second location is angularly spaced apart from the first location around the circumferential wall. A cover selectively covers the second gripper. The processor identifies sheets of the first length or sheets of the second length being fed to the marking device. The first length is greater than the length of the circumferential arc between the first gripper and the second gripper and the second length is less than the length of the circumferential arc between the first gripper and the second gripper. Responsive to the processor identifying sheets of the first length being fed to the marking device, the processor causes the cover to cover the second gripper providing a smooth curved surface over the second gripper. The marking device renders images on the sheets of the first length. The processor outputs the media containing the images.

These and other features are described in, or are apparent from, the following detailed description.

BRIEF DESCRIPTION OF THE DRAWINGS

Various examples of the devices and methods are described in detail below, with reference to the attached drawing figures, which are not necessarily drawn to scale and in which.

DETAILED DESCRIPTION

Figure 1:
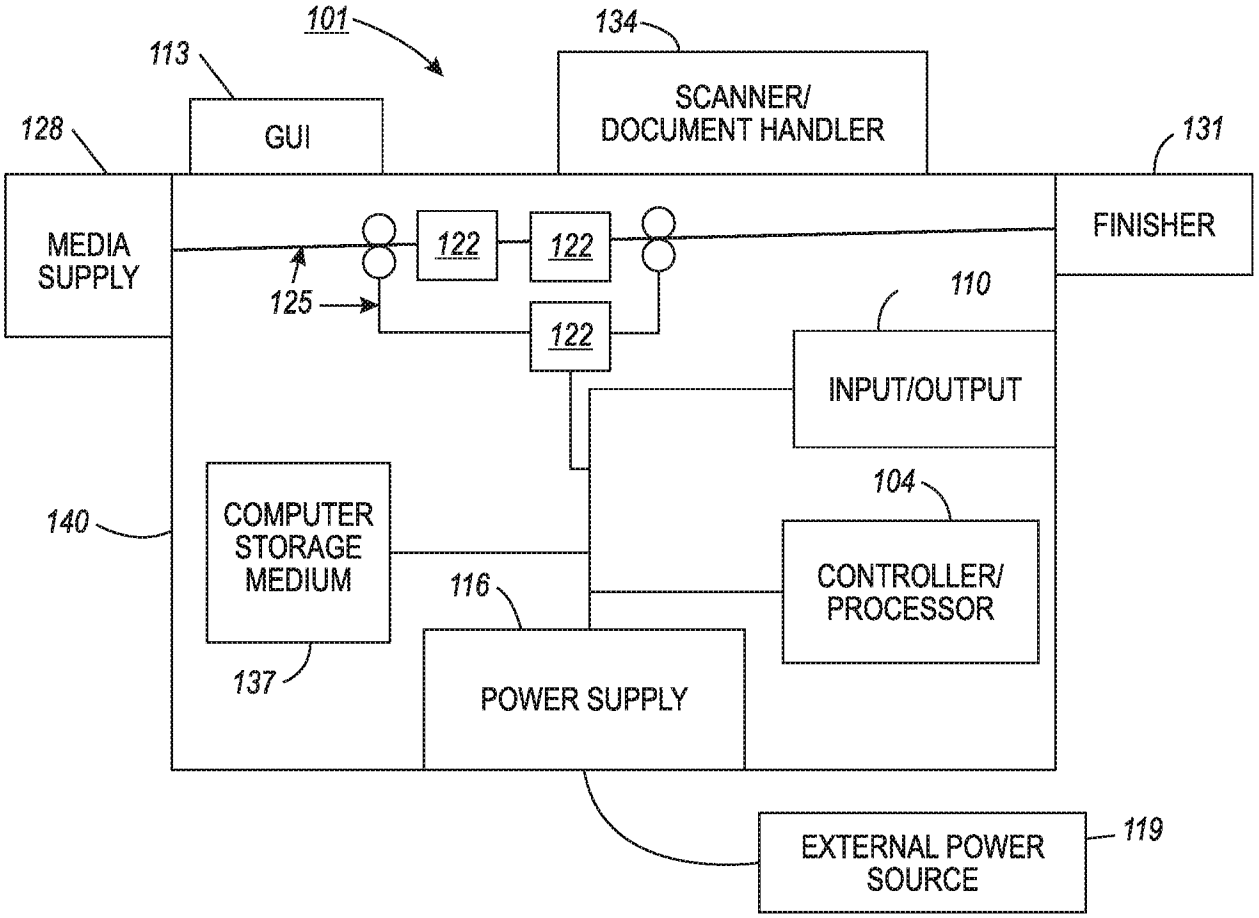
FIG. 1 is a side-view schematic diagram of a printing device according to devices and methods herein.

The disclosure will now be described by reference to a printing apparatus that includes an impression cylinder having more than one set of grippers angularly spaced apart around the circumference of the impression cylinder and having a cover for grippers that are not being used. The cover provides a smooth curved surface over the gripper not being used. While the disclosure will be described hereinafter in connection with specific devices and methods thereof, it will be understood that limiting the disclosure to such specific devices and methods is not intended. On the contrary, it is intended to cover all alternatives, modifications, and equivalents as may be included within the spirit and scope of the disclosure as defined by the appended claims.

For a general understanding of the features of the disclosure, reference is made to the drawings. In the drawings, like reference numerals have been used throughout to identify identical elements.

The term 'printer', 'printing device', 'reproduction apparatus', or 'imaging apparatus' as used herein broadly encompasses various printers, copiers, or multifunction machines or systems, xerographic, lithographic, inkjet, or otherwise, unless otherwise defined in a claim. The term 'sheet' or 'substrate' herein refers to any flimsy physical sheet of paper, plastic, or other useable physical substrate for printing images thereon, whether precut or initially web fed. A compiled collated set of printed output sheets may be alternatively referred to as a document, booklet, or the like. It is also known to use interposers or inserters to add covers or other inserts to the compiled sets.

Referring to the FIG. 1, a printing device 101 is shown which can be used with devices and methods herein and can comprise, for example, a printer, copier, multi-function machine, multi-function device (MFD), etc. The printing device 101 includes a controller/processor 104 and an input/output device 110 operatively connected to the controller/processor 104. The controller/processor 104 may be connected to a computerized network external to the printing device 101 through a communications port of the input/output device 110. In addition, the printing device 101 can include at least one accessory functional component, such as a user interface (GUI) 113. The GUI 113 acts as common interface for job submission and operates on power supplied from a power supply 116. An external power source 119 may provide electrical power to the printing device 101 through the power supply 116. The input/output device 110 is used for communications to and from the printing device 101. The controller/processor 104 controls the various actions of the printing device 101.

The printing device 101 may include at least one marking device 122 (sometimes referred to as print engines) operatively connected to the controller/processor 104. A media transportation path 125 is positioned to supply sheets of printable media from a media supply 128 (that includes paper trays media size sensors connected to the controller/processor 104) to the marking device(s) 122, etc., along the media transportation path 125. After receiving various markings from the printing engine(s), the sheets of media can optionally pass to a finisher 131 which can fold, staple, sort, etc., the various printed sheets.

Further, the marking device 122 is any device capable of rendering an image. The set of marking devices includes digital document reproduction equipment and other copier systems as are widely known in commerce, photographic production and reproduction equipment, monitors and other displays, computer workstations and servers, including a wide variety of color marking devices, and the like.

To render an image is to reduce the image data (or a signal thereof) to viewable form; store the image data to memory or a storage device for subsequent retrieval; or communicate the image data to another device. Such communication may take the form of transmitting a digital signal of the image data over a network.

In addition, the printing device 101 can include one or more accessory functional component (such as a scanner/document handler 134, etc.) that also operates on the power supplied from the external power source 119 (through the power supply 116).

The scanner/document handler 134 may be any image input device capable of obtaining information from an image. The set of image input devices is intended to encompass a wide variety of devices such as, for example, digital document devices, computer systems, memory and storage devices, networked platforms such as servers and client devices which can obtain pixel values from a source device, and image capture devices. The set of image capture devices includes scanners, cameras, photography equipment, facsimile machines, photo reproduction equipment, digital printing presses, xerographic devices, and the like. A scanner is one image capture device that optically scans images, print media, and the like, and converts the scanned image into a digitized format. Common scanning devices include variations of the flatbed scanner, generally known in the art, wherein specialized image receptors move beneath a platen and scan the media placed on the platen. Modern digital scanners typically incorporate a charge-coupled device (CCD) or a contact image sensor (CIS) as the image sensing receptor(s). The scanning device produces a signal of the scanned image data. Such a digital signal contains information about pixels such as color value, intensity, and their location within the scanned image.

The printing device 101 may also include a non-transitory computer storage medium 137 (which can be optical, magnetic, capacitor based, etc.) readable by the controller/processor 104. The non-transitory computer storage medium 137 stores instructions that the controller/processor 104 executes to allow the printing device 101 to perform its various functions, such as those described herein.

It should be understood that the controller/processor 104 as used herein comprises a computerized device adapted to perform (i.e., programmed to perform, configured to perform, etc.) the below described system operations. According to systems and methods herein, the controller/processor 104 comprises a programmable, self-contained, dedicated mini-computer. The details of such computerized devices are not discussed herein for purposes of brevity and reader focus.

Thus, as shown in FIG. 1, a device housing 140 has one or more functional components that operate on power supplied from the external power source 119, which may comprise an alternating current (AC) power source, through the power supply 116. The power supply 116 can comprise a power storage element (e.g., a battery) and connects to the external power source 119. The power supply 116 converts the external power into the type of power needed by the various components of the printing device 101.

Printing devices, such as shown in FIG. 1, are typically full featured. Various ones of the features provide one or more functions to be performed on a job. For example, a job may include capturing an image at the image input section for storage. The image may undergo a significant amount of image processing allowing for the minimization of image related artifacts and various electronic pages may be edited after the job has been suitably stored. After outputting of the stored job, a host of finishing operations, such as stapling, folding, and trimming may be performed on the hardcopy version of the job to optimize its appearance.

As would be understood by those ordinarily skilled in the art, the printing device 101 shown in FIG. 1 is only one example, and the devices and methods herein are equally applicable to other types of printing devices that may include fewer components or more components. For example, while a limited number of printing engines and paper paths are illustrated in FIG. 1, those ordinarily skilled in the art would understand that many more paper paths and additional printing engines could be included within any printing device used with devices and methods herein.

In other words, an exemplary imaging system comprises a multifunctional device with print, copy, scan, and fax services. Such multifunctional devices are well known in the art and may comprise print engines based upon liquid or solid ink jet, electrophotography, other electrostatographic technologies, and other imaging technologies. The general principles of imaging are well known to many skilled in the art and are described above as an example of an imaging system to which the present concepts is applicable.

Figure 2:
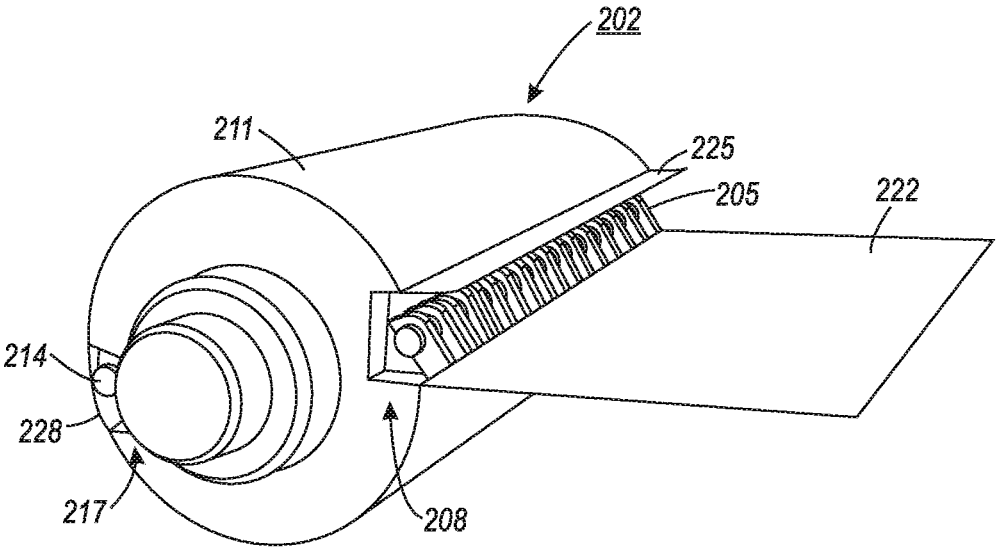
FIG. 2 is a perspective view of an impression cylinder and a document according to devices and methods herein.
Figure 3A:
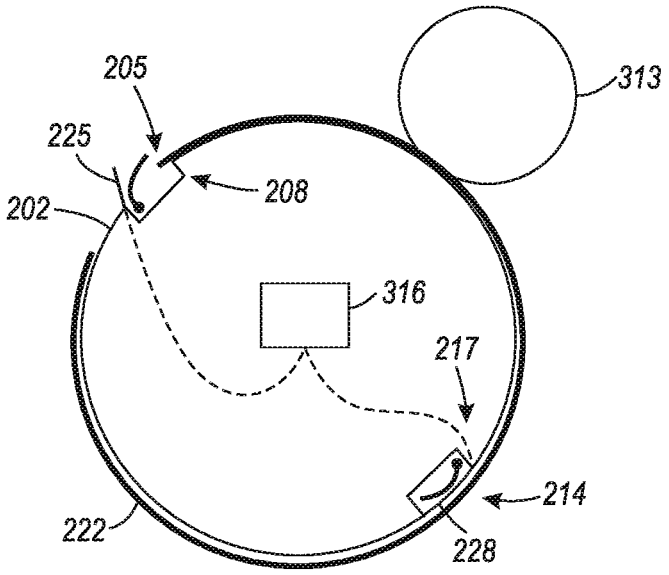
FIG. 3A is a side view of an impression cylinder and roller according to devices and methods herein.
Figure 3B:
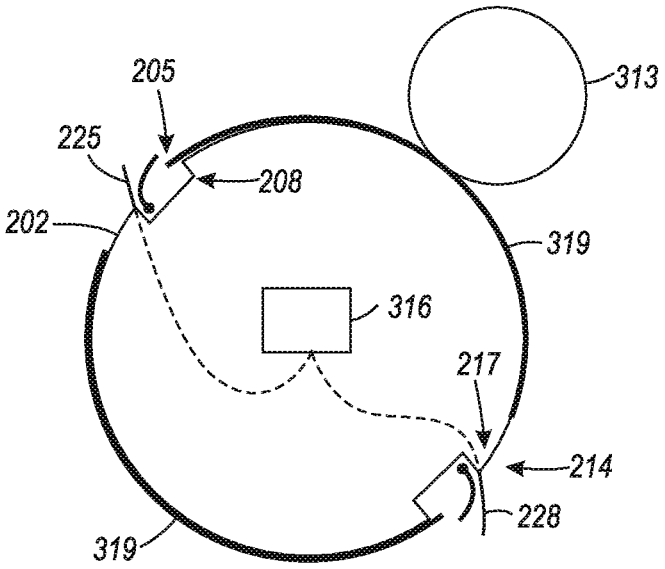
FIG. 3B is side view of an impression cylinder and roller according to devices and methods herein.

FIG. 2 shows an impression cylinder 202 having a first gripper 205 positioned in a first location 208 on a circumferential wall 211 of the impression cylinder 202. A second gripper 214 is positioned in a second location 217 on the circumferential wall 211 of the impression cylinder 202. As best seen in FIGS. 3A and 3B the second location 217 is angularly spaced apart from the first location 208 around the circumferential wall 211. For example, an impression cylinder 202 of 30" circumference would have two grippers separated by 180 degrees. In practice, such a system could use one gripper to hold the short edge of a 20"×30" sheet, or use two grippers to hold the short edge of two 15"×20" sheets. While the drawings illustrate an impression cylinder 202 having two grippers separated by 180 degrees, it is contemplated that three or more grippers may be angularly spaced around the circumference of the impression cylinder 202.

In press operation, a sheet of paper 222 is retained by the grippers 205, 214 and, as the impression cylinder 202 rotates, the sheet of paper 222 is wrapped around the impression cylinder 202 against its circumferential wall 211. In the lithographic printing process, uniform pressure on the sheet of paper 222, applied between the impression cylinder 202 and an inked blanket cylinder 313 (FIGS. 3A and 3B) transfers an image to the sheet of paper 222. Similar press geometry is practical for direct-to-paper digital inkjet printing, with the grippers 205 or 214 of the impression cylinder 202 and pressure rollers holding the sheet of paper 222 taught to the smooth surface of the impression cylinder 202 while ink is jetted onto the sheet of paper 222. Ink jet printing needs a very smooth surface with tightly controlled distance between the sheet of paper 222 and the print head. According to devices and methods herein, the grippers 205, 214 may be provided a moveable cover, such as cover 225 for the first gripper 205 and cover 228 for the second gripper 214. The covers 225, 228 are provided to selectively cover any unused gripper in order to provide a smooth curved surface over the gap where the unused gripper is located.

FIGS. 3A and 3B show an inkjet printing system capable of printing of two different paper lengths: half the circumference of the impression cylinder 202 and the full circumference of the impression cylinder 202. In FIG. 3A, a full-circumference sheet of paper 222 is wrapped around the impression cylinder 202 and held by the first gripper 205. Using just one set of grippers (e.g., the first gripper 205), a non-uniform imaging (print quality defects) would occur on the sheet of paper 222 at the point where it overlaps the gap for the unused set of grippers (e.g., the second gripper 214). A cover 228 is provided to selectively cover the second gripper 214 providing a smooth curved surface over the second gripper 214 when the length of the sheet of paper 222 is greater than the length of the circumferential arc between the first gripper 205 and the second gripper 214. An actuator 316 can selectively control the position of the covers 225, 228. The actuator may operate by any appropriate means, such as electrical, hydraulic, pneumatic, and the like.

In FIG. 3B, an impression cylinder 202 with two-grippers 205, 214 can readily print shorter-length sheets of paper 319 when the length of the sheet is less than the length of the circumferential arc between the first gripper 205 and the second gripper 214, e.g., half the circumference of the impression cylinder 202 or less. Note, as shown in FIG. 3B, both the covers 225, 228 can be hinged to open and allow the grippers 205 or 214 to operate. The actuator 316 selectively controls the position of the covers 225, 228. According to devices and methods herein, the actuator 316 can allow either of the grippers 205, 214 to grasp a full-circumference sheet of paper 222 without having to rotate to the position where only the first gripper 205 would grip the full-circumference sheet of paper 222. In other words, having a cover 225, 228 for both grippers 205, 214 allows either gripper (205 or 214) to grasp the longer, full-circumference sheet of paper 222.

Figure 4A:
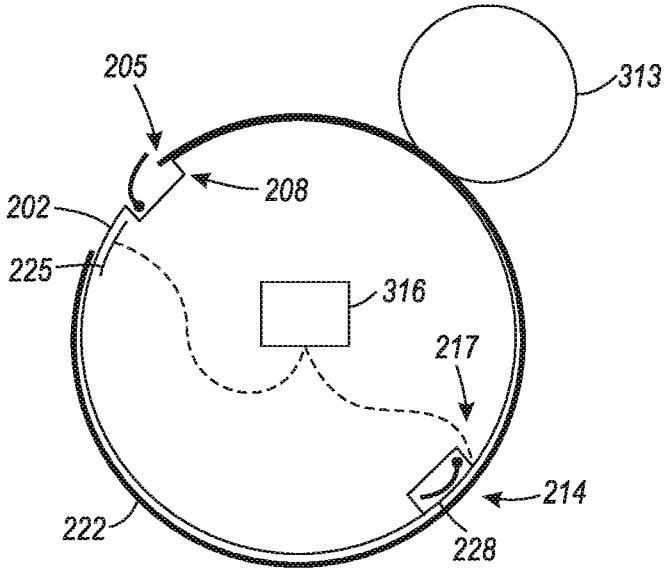
FIG. 4A is a side view of an impression cylinder and roller according to devices and methods herein.
Figure 4B:
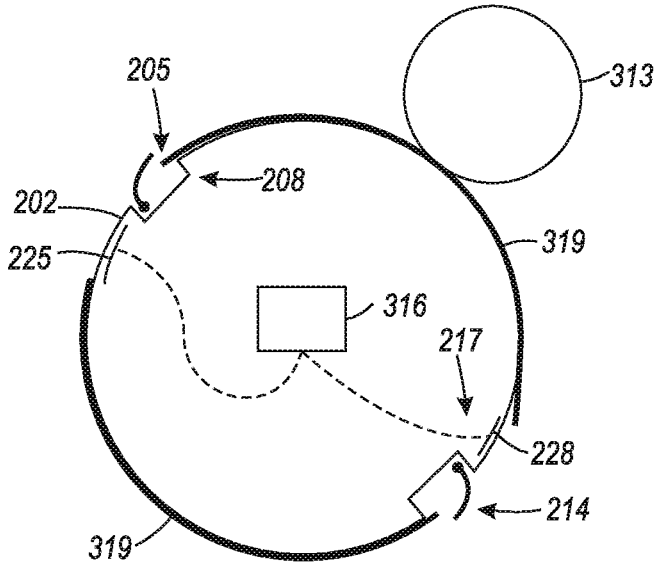
FIG. 4B is side view of an impression cylinder and roller according to devices and methods herein.

FIGS. 4A and 4B show another configuration of the covers 225, 228 in which they can move into a slot, pocket, or other housing just under the outer surface of the impression cylinder 202.

Devices herein disclose a modification of the traditional lithographic press architecture to enable multiple points for gripping a sheet of paper 222. According to devices herein, the mechanical design of at least one of the grippers 205, 214 includes a cover 225, 228. The cover 225, 228 can be selectively disposed such that the gap in the impression cylinder 202 occupied by the gripper not in active use is filled, such that the surface of the impression cylinder 202 in that region is smooth and continuous with the surrounding region. Such modifications provide the time-proven registration advantages of gripper-based architectures, while also achieving efficient print rates for smaller sheet sizes. It is contemplated that this architecture can be used for direct-to-paper inkjet printing, but may also be combined with other marking technologies.

The traditional lithographic method of impression cylinders and grippers enables very high precision image-to-paper registration. But a principal value of digital printing is that, absent a printing plate (of necessarily fixed size), printing sheets of different lengths is readily possible. Devices disclosed herein allow the marriage of these two values i.e., tight registration and variable sheet size.

The devices and methods described herein disclose a sheet conveyance system. The sheet registration and conveyance system includes an impression cylinder 202. A first gripper 205 is positioned in a first location 208 on a circumferential wall 211 of the impression cylinder 202. A second gripper 214 is positioned in a second location 217 on the circumferential wall 211 of the impression cylinder 202. The second location 217 is angularly spaced apart from the first location 208 around the circumferential wall 211. The system includes sheet supply devices, such as media supply 128, supplying first sheets of paper 222 having a first length and second sheets of paper 319 having a second length. The first length is greater than the length of the circumferential arc between the first gripper 205 and the second gripper 214 and the second length is less than the length of the circumferential arc between the first gripper 205 and the second gripper 214. Responsive to substrates of the second length being supplied (i.e., less than the length of the circumferential arc between the first gripper 205 and the second gripper 214), the first gripper 205 grips a leading edge of a first sheet of paper from the media supply 128 and the second gripper 214 grips a leading edge of a second sheet from the media supply 128. Responsive to substrates of the first length being supplied (i.e., greater than the length of the circumferential arc between the first gripper 205 and the second gripper 214), the first gripper 205 grips a leading edge of a sheet from the media supply 128 and the cover 228 provides a smooth curved surface over the second gripper 214.

According to a printing system herein, the printing system includes a controller/processor 104, a marking device, such as transfer station 32, operatively connected to the controller/processor 104, and sheet supply devices, such as media supply 128. The sheet supply devices supply sheets of paper 222 having a first length and sheets of paper 222 having a second length to the marking device. The marking device includes an impression cylinder 202. A first gripper 205 is positioned in a first location 208 on a circumferential wall 211 of the impression cylinder 202. A second gripper 214 is positioned in a second location 217 on the circumferential wall 211 of the impression cylinder 202. The second location 217 is angularly spaced apart from the first location 208 around the circumferential wall 211. A cover 228 selectively covers the second gripper 214. The controller/processor 104 identifies sheets of paper 222 having the first length or sheets of paper 222 having the second length being fed to the marking device. The first length is greater than the length of the circumferential arc between the first gripper 205 and the second gripper 214 and the second length is less than the length of the circumferential arc between the first gripper 205 and the second gripper 214. Responsive to the controller/processor 104 identifying sheets of paper 222 having the first length being fed to the marking device, the controller/processor 104 causes the cover 228 to cover the second gripper 214 providing a smooth curved surface over the second gripper 214. The marking device renders images on the sheets of paper 222 having the first length. The controller/processor 104 outputs the sheets of paper 222 containing the images.

In other words, one of the concepts disclosed is to selectively cover the gap over the unused gripper with a smooth curved surface in order to achieve defect-free printing, while dynamically printing sheets of different lengths.

The corresponding structures, materials, acts, and equivalents of all means or step plus function elements in the claims below are intended to include any structure, material, or act for performing the function in combination with other claimed elements as specifically claimed. The descriptions of the various devices and methods of the present disclosure have been presented for purposes of illustration, but are not intended to be exhaustive or limited to the devices and methods disclosed. Many modifications and variations will be apparent to those of ordinary skill in the art without departing from the scope and spirit of the described devices and methods. The terminology used herein was chosen to best explain the principles of the devices and methods, the practical application or technical improvement over technologies found in the marketplace, or to enable others of ordinary skill in the art to understand the devices and methods disclosed herein.

As mentioned above, the terms 'printer' or 'printing device' as used herein encompasses any apparatus, such as a digital copier, bookmaking machine, facsimile machine, multi-function machine, etc. that performs a print outputting function for any purpose. The devices and methods herein can encompass devices that print in color, monochrome, or handle color or monochrome image data. All foregoing devices and methods are specifically applicable to electrostatographic and/or xerographic machines and/or processes.

The terminology used herein is for the purpose of describing particular devices and methods only and is not intended to be limiting of this disclosure. As used herein, the singular forms "a", "an", and "the" are intended to include the plural forms as well, unless the context clearly indicates otherwise. It will be further understood that the terms "comprises," "comprising," and/or "including," when used in this specification, specify the presence of stated features, integers, steps, operations, elements, and/or components, but do not preclude the presence or addition of one or more other features, integers, steps, operations, elements, components, and/or groups thereof. Further, the terms 'automated' or 'automatically' mean that once a process is started (by a machine or a user); one or more machines perform the process without further input from any user.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements).

It will be appreciated that the above-disclosed and other features and functions, or alternatives thereof, may be desirably combined into many other different systems or applications. Those skilled in the art may subsequently make various presently unforeseen or unanticipated alternatives, modifications, variations, or improvements therein, which are also intended to be encompassed by the following claims. Unless specifically defined in a specific claim itself, steps or components of the systems and methods herein should not be implied or imported from any above example as limitations to any particular order, number, position, size, shape, angle, color, temperature, or material.

What is claimed is:

1. An apparatus, comprising:

a processor;

a sheet supply device feeding substrates to a printing system; and an impression cylinder comprising:

a first gripper positioned in a first location on a circumferential wall of said impression cylinder, a second gripper positioned in a second location on said circumferential wall of said impression cylinder, said second location being angularly spaced apart from said first location around said circumferential wall, and a cover selectively covering said second gripper, said processor identifying substrates of a first length being fed to said printing system, said first length being greater than the length of the circumferential arc between said first gripper and said second gripper, responsive to said first gripper gripping an edge of said substrate of said first length supplied from said sheet supply device, said processor causing said cover to cover said second gripper.

2. The apparatus according to claim 1, said sheet supply device supplying substrates of a second length, said second length being less than the length of the circumferential arc between said first gripper and said second gripper.

3. The apparatus according to claim 2, said second length being approximately one-half of said first length.

4. The apparatus according to claim 2, said first gripper gripping a leading edge of a first sheet from said sheet supply device and said second gripper gripping a leading edge of a second sheet from said sheet supply device.

5. The apparatus according to claim 1, further comprising:

a marking device rendering images on said substrate.

6. The apparatus according to claim 5, said marking device comprising an inkjet printer.

7. The apparatus according to claim 1, said first gripper providing image-to-paper registration and said cover providing a smooth, curved surface over said second gripper.

8. The apparatus according to claim 1, further comprising:

a cover selectively covering said first gripper, said cover providing a smooth curved surface over said first gripper.

9. A sheet conveyance system, comprising:

a processor;

an impression cylinder comprising:

a first gripper positioned in a first location on a circumferential wall of said impression cylinder, a second gripper positioned in a second location on said circumferential wall of said impression cylinder, said second location being angularly spaced apart from said first location around said circumferential wall, and a cover selectively covering said second gripper; and sheet supply devices supplying first substrates having a first length and second substrates having a second length, said first length being greater than the length of the circumferential arc between said first gripper and said second gripper and said second length being less than the length of the circumferential arc between said first gripper and said second gripper, responsive to said processor identifying substrates of said second length being supplied, said processor causing said first gripper to grip a leading edge of a first sheet from a sheet supply device and said second gripper to grip a leading edge of a second sheet from said sheet supply device, and responsive to said processor identifying substrates of said first length being supplied, said processor causing said first gripper to grip a leading edge of a sheet from said sheet supply device and causing said cover to cover said second gripper.

10. The system according to claim 9, said second length being approximately one-half of said first length.

11. The system according to claim 9, further comprising:

a marking device rendering images on one of said first substrates and said second substrates.

12. The system according to claim 11, said marking device comprising an inkjet printer.

13. The system according to claim 9, said first gripper providing image-to-paper registration and said cover providing a smooth, curved surface over said second gripper.

14. The system according to claim 9, further comprising:

a cover selectively covering said first gripper, said cover providing a smooth curved surface over said first gripper.

15. A printing system, comprising:

a processor;

a marking device operatively connected to said processor; and sheet supply devices supplying sheets of a first length and sheets of a second length to said marking device;

said marking device comprising an impression cylinder comprising:

a first gripper positioned in a first location on a circumferential wall of said impression cylinder, a second gripper positioned in a second location on said circumferential wall of said impression cylinder, said second location being angularly spaced apart from said first location around said circumferential wall, and a cover selectively covering said second gripper, said processor identifying sheets of said first length or sheets of said second length being fed to said marking device, said first length being greater than the length of the circumferential arc between said first gripper and said second gripper and said second length being less than the length of the circumferential arc between said first gripper and said second gripper, responsive to said processor identifying sheets of said first length being fed to said marking device, said processor causing said cover to cover said second gripper, said marking device rendering images on said sheets of said first length, and said processor outputting media containing said images.

16. The printing system according to claim 15, further comprising:

responsive to said processor identifying sheets of said first length being fed to said marking device, said processor causing said first gripper to grip a leading edge of a first sheet from a sheet supply devices.

17. The printing system according to claim 16, said first gripper providing image-to-paper registration and said cover providing a smooth, curved surface over said second gripper.

18. The printing system according to claim 15, said second length being approximately one-half of said first length.

19. The printing system according to claim 15, responsive to said processor identifying sheets of said second length being fed to said marking device, said first gripper gripping a leading edge of a first sheet from said sheet supply device and said second gripper gripping a leading edge of a second sheet from said sheet supply device, said marking device rendering images on said sheets of said second length.

20. The printing system according to claim 15, said marking device comprising an inkjet printer.

* * * * *